US006837448B2

(12) United States Patent
Han et al.

(10) Patent No.: US 6,837,448 B2
(45) Date of Patent: Jan. 4, 2005

(54) NOZZLE DEVICE FOR SPRAYING DEFINED AREAS

(75) Inventors: Joseph U. Han, Rancho Cucamonga, CA (US); Giles A. Kendall, Rancho Cucamonga, CA (US)

(73) Assignee: Streamtech, Inc., Rancho Cucamonga, CA (US)

( * ) Notice: Subject to any disclaimer, the term of this patent is extended or adjusted under 35 U.S.C. 154(b) by 103 days.

(21) Appl. No.: 10/007,884

(22) Filed: Nov. 9, 2001

(65) Prior Publication Data

US 2002/0053609 A1 May 9, 2002

Related U.S. Application Data

(60) Provisional application No. 60/246,913, filed on Nov. 9, 2000.

(51) Int. Cl.[7] ..... B05B 1/26

(52) U.S. Cl. ..... 239/499; 239/500; 239/502; 239/518; 239/522

(58) Field of Search ..... 239/499, 500, 239/502, 518, 522, 509, 521, 523, 524, DIG. 1, 201, 203

(56) References Cited

U.S. PATENT DOCUMENTS

| | | | | | |
|---|---|---|---|---|---|
| 1,964,269 | A | * | 6/1934 | Munz | 239/521 |
| 3,029,030 | A | * | 4/1962 | Dey | 239/520 |
| 3,085,754 | A | * | 4/1963 | Thompson | 239/523 |
| 3,788,552 | A | * | 1/1974 | Roberts | 239/276 |
| 4,168,033 | A | * | 9/1979 | von Bernuth et al. | 239/523 |

* cited by examiner

*Primary Examiner*—Michael Mar
*Assistant Examiner*—Darren Gorman
(74) *Attorney, Agent, or Firm*—Boniard I. Brown

(57) ABSTRACT

A sprinkler apparatus has a nozzle of a cross-sectional configuration to provide a liquid jet of similar cross-sectional configuration which impacts a reflector surface to reflect a spray of a cross-sectional configuration similar to that of an area to be sprayed. The nozzle passage and reflector surface may preferably be defined on a unitary nozzle device mounted on a base.

8 Claims, 4 Drawing Sheets

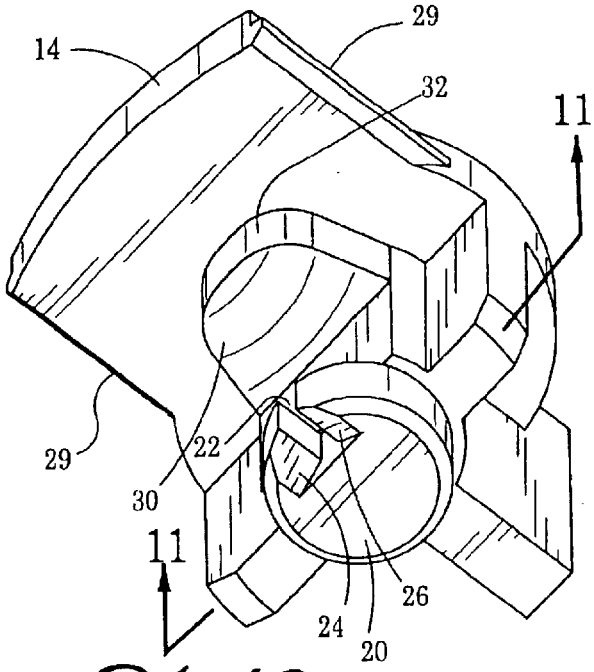
FIG. 10
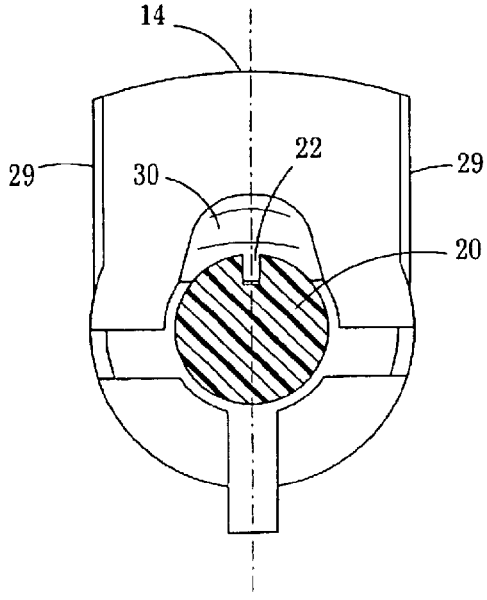
FIG. 11
FIG. 12
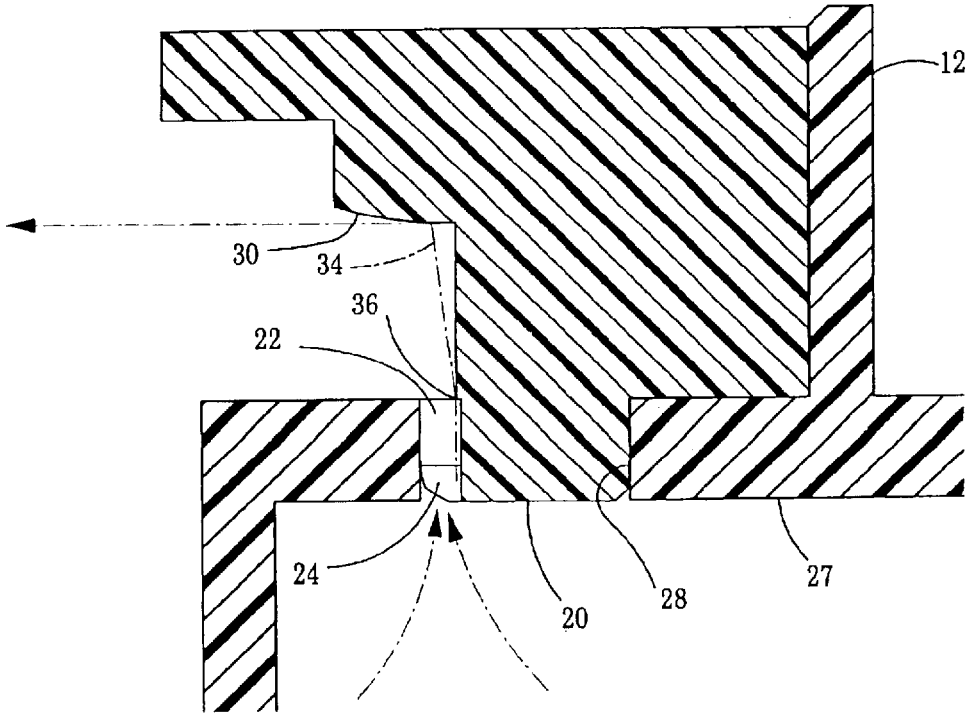

NOZZLE DEVICE FOR SPRAYING DEFINED AREAS

RELATED APPLICATIONS

Reference is made to our Provisional Application No. 60/246,913, filed Nov. 9, 2000.

BACKGROUND AND SUMMARY OF THE INVENTION

Sprinkler devices of the prior art for spraying or sprinkling areas, such as ground areas of grass or plants, generally do not evenly sprinkle particular defined areas accurately. FIG. 1 shows diagrammatically a plurality of conventional sprinklers A spraying semi-circular patterns which overlap, some areas getting substantially more spray and water than others, as indicated at B.

Sprinkler devices according to the invention provide relatively accurate and equalized spraying over predetermined defined areas, such as a generally rectangular area. FIG. 2 shows diagrammatically a plurality of sprinklers 10 of the invention arrayed to spray respective defined rectangular areas C evenly.

FIG. 3 is a top view of a sprinkler device 10 of the invention in relation to a reduced scale showing of a rectangular area being evenly sprayed. FIG. 3A is a top view of an assembly of two sprinkler devices of the invention mounted in a common frame 11 and spraying respective rectilinear areas evenly.

A sprinkler device according to the invention comprises a base for attachment to a conventional sprinkler assembly, and a nozzle mounted on the base and adapted to provide a liquid jet of a predetermined cross-sectional configuration. Typically, the liquid jet would be rectilinrar in cross-section. The liquid jet impacts a reflector surface contoured and adapted to reflect the liquid jet into a spray to a defined area to be sprayed. The spray has a cross-sectional configuration similar to that of the liquid jet from the nozzle passage, thus to spray an area of generally similar configuration relatively accurately.

The reflector surface has variations from a generally convex surface, thus to reflect respective spray portions with respective inclinations from the reflector surface to define respective portions of a spray to respective portions of an area to be sprayed.

BRIEF DESCRIPTION OF THE DRAWINGS

FIG. 10 is a bottom perspective view of a sprinkler device according to the invention;

FIG. 11 is a sectional view taken at line 11—11 in FIG. 10;

FIG. 12 is a sectional view taken at line 12—12 in FIG. 7; and

DESCRIPTION OF THE PREFERRED EMBODIMENTS

The present invention relates to assemblies for the sprinkling or watering of a pre-determined defined area, typically a generally rectangular area. Devices according to the invention are adapted for miniaturization to cover relatively small defined areas.

Devices according to the present invention are primarily for use in the sprinkling or watering of small areas. Such an area might be 2'×3' and probably no larger than 8' in dimension. The nozzle base may typically be ¾" in diameter, with a nozzle passage which is very small. Such areas are commonly utilized in dry areas, such as in the State of Arizona where climate conditions and the cost of water render the watering of large areas undesirable.

Figure 1:
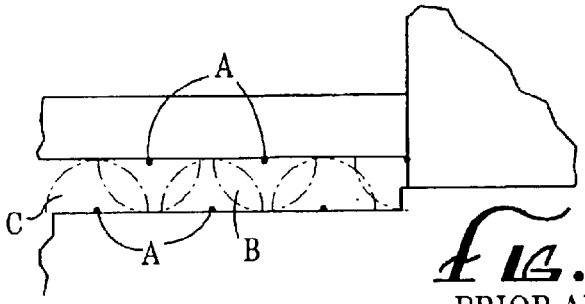
FIG. 1 PRIOR ART
FIG. 1 is a diagrammatic partial view of a prior art arrangement of conventional spray nozzles, showing overlapped, curvilinear areas of spray.
Figure 2:
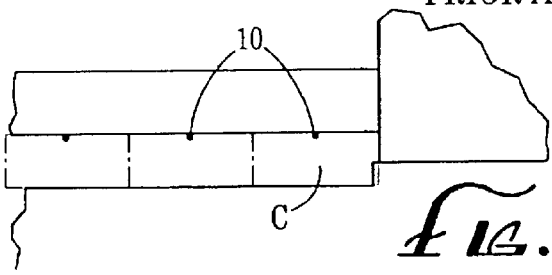
FIG. 2 is a diagrammatic partial view showing a plurality of spray nozzles of the present invention to cover respective rectilinear areas sprayed thereby.
Figure 3:
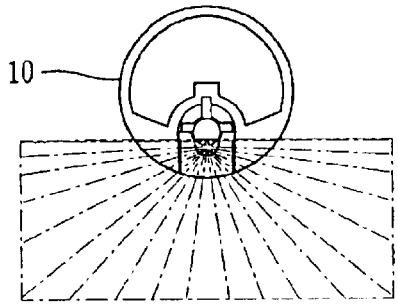
FIG. 3 is a top view of a sprinkler apparatus of the present invention in relation to a rectilinear area being sprayed.
Figure 3A:
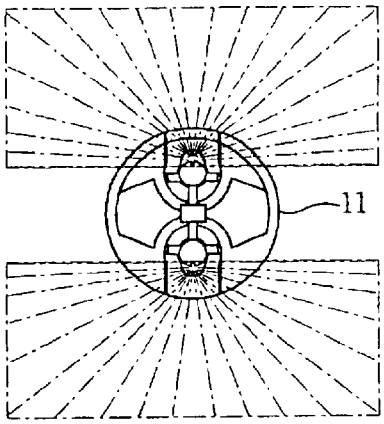
FIG. 3A is a top view of two sprinkler devices according to the invention mounted in a common frame and spraying two rectangular areas.
Figure 4:
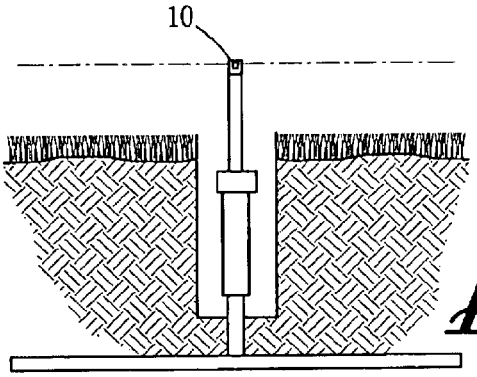
FIG. 4 is a sectional view showing a device of the invention atop a pop-up type conventional sprinkler apparatus, disposed in a ground opening.
Figure 5:
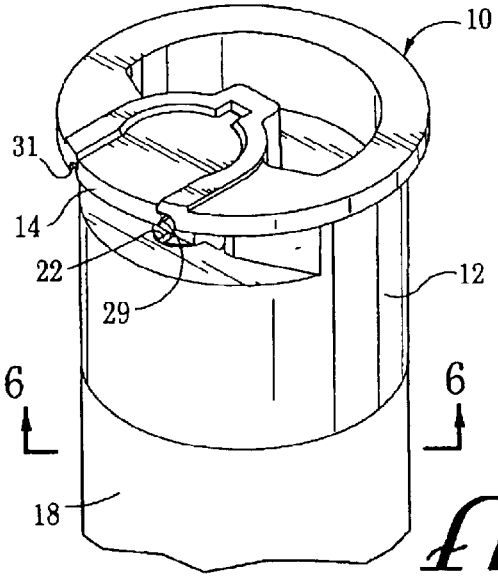
FIG. 5 is a perspective view of a sprinkler device according to the invention atop a conventional sprinkler system.
Figure 6:
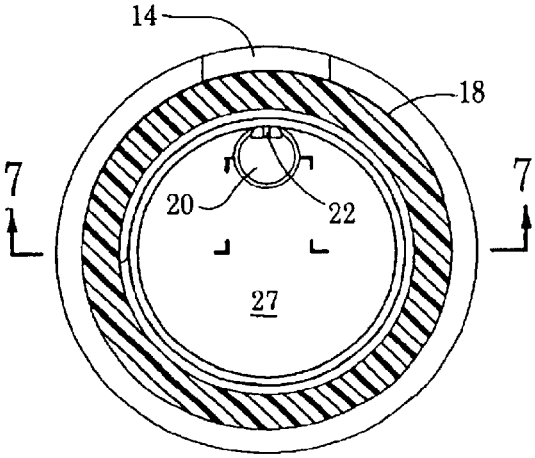
FIG. 6 is a sectional view taken at line 6—6 in FIG. 5.
Figure 7:
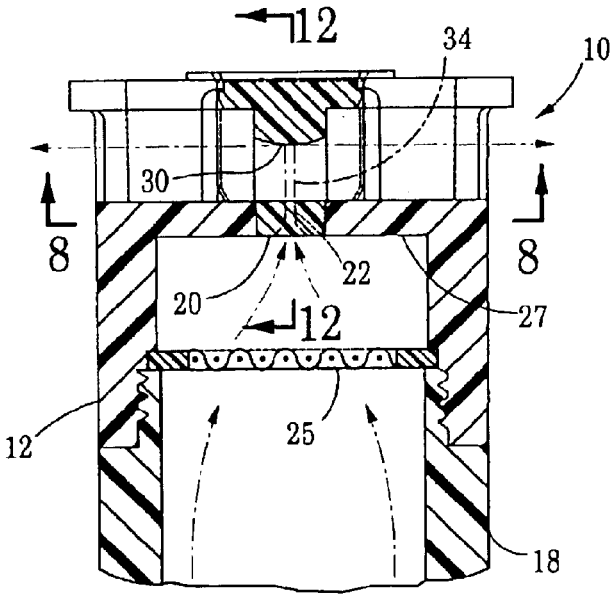
FIG. 7 is a sectional view taken at line 7—7 in FIG. 6.
Figure 8:
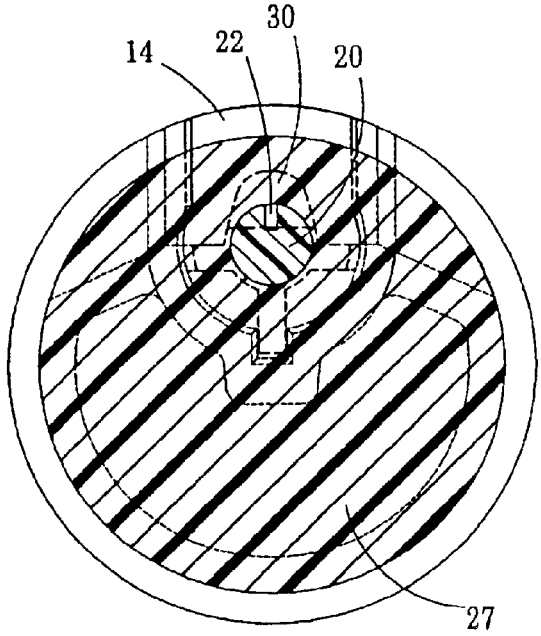
FIG. 8 is a sectional view taken at line 8—8 in FIG. 7.

Referring to FIGS. 5–7, the sprinkler device 10 according to the invention comprises a base 12 on which is mounted a nozzle device 14, supplied with liquid under pressure via base 12 which is threadedly mounted by a threaded portion 16 to a housing 18 of a conventional sprinkler apparatus housing (not shown).

A conventional apparatus may typically be the well-known "pop-up" type. A filter or screen 25 (FIG. 7) is mounted in base 12 to filter out all particles, grains of sand, etc., which because of the very small size of nozzle passage, can plug the passage and prevent passage of water therethrough.

A feature of the invention, as best shown in FIG. 10, is the provision of a nozzle device wherein a nozzle passage and a reflector surface are defined on a unitary integral single component, preferably produced from a precision steel mold. This serves to minimize or eliminate variations from nominal dimensions, and cumulative dimensional errors resulting from assemblies separate molded parts.

Figure 9:
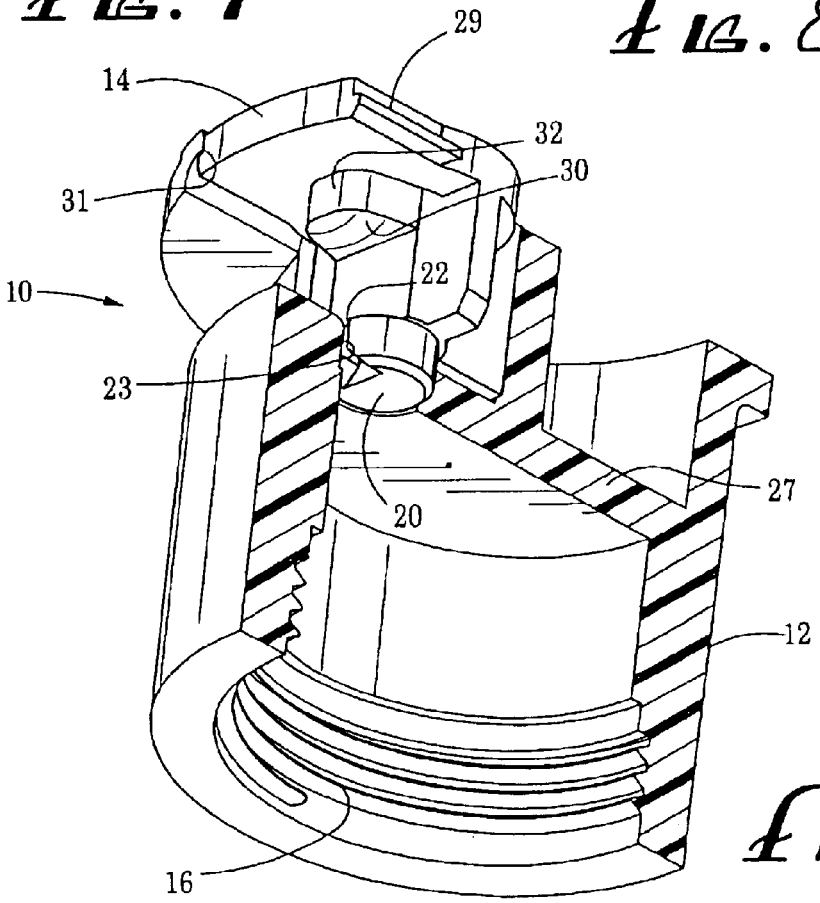
FIG. 9 is a perspective cutaway view of a sprinkler device of the invention mounted in a base according to the invention.

The nozzle device 14 is a unitary snap-insert device. The nozzle device is installed by simply snapping its ridge portions 29 into grooves 31 in base 12 (FIGS. 9 and 10), inserting it from outside a complete sprinkler. It is not necessary to disassemble a conventional sprinkler to install any particular nozzle. Such processes are more expensive than a snap-in design according to the invention. The snap-in nozzle insert incorporates integral alignment, as between the nozzle passage and reflector surface. It is installed from outside the completed sprinkler apparatus. In contrast, conventional nozzles are generally welded together, and welding can introduce distortion.

A preferred material of the integral component defining the nozzle body and the reflector is an unfilled ABS thermoplastic or similar material. Such material is capable of maintaining precise dimensions while providing reasonable abrasion resistance in long-term service. These components may be formed of one of (a) ABS plastic, (b) a material equivalent to such ABS plastic, (c) other appropriate material. Such material has a low shrinkage rate without any added filler, and the low shrink rate of the material reduces warping in a final molded part. Any minor inaccuracy or warp in the configuration of certain components, particularly the reflector surface, can effect the final liquid output spray pattern. Although other materials might be utilized, it would be with attendant sacrifice of performance. A thermoplastic polyester can provide wear resistance, but with higher shrink rate, and it is more expensive and more sensitive to moisture during molding, and can provide a more variant end product, with less user satisfaction.

A step 36 is defined at the output end of nozzle passage 22 in a wall adjacent to the nozzle (FIG. 12). The step serves first to deflect slightly outwardly the liquid jet from the nozzle, as indicated, thus to offset the inner portion of the spray to prevent a heavy stream from its rear edges. Otherwise, there would be produced a certain outward extension or bulging of a pattern of spray to an area being sprinkled.

The nozzle device 14 has a lower ring portion 20 which is force-fitted into a circular opening 28 in upper wall 27 of base 12. A portion 23 of inner base wall defines a wall or side of the nozzle passage, as perhaps best indicated in FIG. 9. The nozzle passage 22 is rectilinear in cross-section, and is thus adapted to provide a liquid output jet of generally rectilinear cross-section. The entrance portion of the nozzle comprises inclined surfaces 24, 26 which, as will be understood from the geometry of the parts, to increase or accelerate liquid flow through the nozzle passage.

Rectilinear cross-section nozzle provides a generally rectilinear liquid jet therefrom thus to enable a predetermined spray pattern from defelector surface, as hereinafter described.

It will be understood that the rectilinear cross-section water jet and rectilinear water spray, are applicable to sprinklers larger than the preferred embodiments herein described.

In the prior art, liquid jets are generally of circular cross-sectional configuration. Efforts to produce a rectilinear spray pattern with such jets have encountered substantial difficulties, and it is difficult, if not impossible, to produce a generally rectilinear spray pattern commencing with a liquid jet of circular cross-section.

A reflector surface 30 is defined on a reflector portion 32. The reflector surface is spaced from the nozzle passage 22 and is accurately aligned therewith to be impacted by the liquid jet 34 from the nozzle passage 22. The reflector surface is adapted and contoured to reflect the jet stream into a spray pattern to sprinkle or spray an area, typically a ground area, of predetermined cross-sectional configuration. The configuration sprayed is generally similar to the cross-sectional area of the jet 34 from nozzle passage 22. The reflector surface is of generally convex configuration and typically is convex in directions 90° apart. The reflector surface has respective portions to effect respective inclinations of spray portions from the reflector surface to respective portions of an area to be sprayed, thus to uniformly spray the area.

Variations of the general convex contour of the reflector surface to effect respective inclinations of spray portions, may be determined either emperically or preferably are defined through the utilization of appropriate computer equipment. By inserting into the computer appropriate information and data as to geometric relations of parts, angles, dimensions, etc., the computer provides 3-dimensional information regarding relationships, contour variations, etc. Such general procedure and computer operation are known to those versed in the art.

The precision liquid jet reflector surface 30 constitutes an important feature of the present invention. Precise alignment of the reflective surface and the nozzle passage is provided. Otherwise, liquid jet from the nozzle will not split evenly upon impacting the deflector surface. Thus, the liquid spray to an area to be sprayed or irrigated, typically rectilinear, will receive more water on one area or side than on another area or side. Thus, over-watering of one portion is required to provide adequate liquid application to another portion. The accurately formed reflector surface 30 serves to provide split liquid spray equally to both halves of an area. It may be noted that the discharge spray may be "mist-like", and thus readily carried away by a light wind.

In certain applications, a "centerline" may be moved by so contouring the reflector surface that it is adapted to spray water farther from one side than from the other side of the reflector surface 30. This may be desirable to provide a higher spray discharge angle on one side to clear low obstructions.

Figure 13:
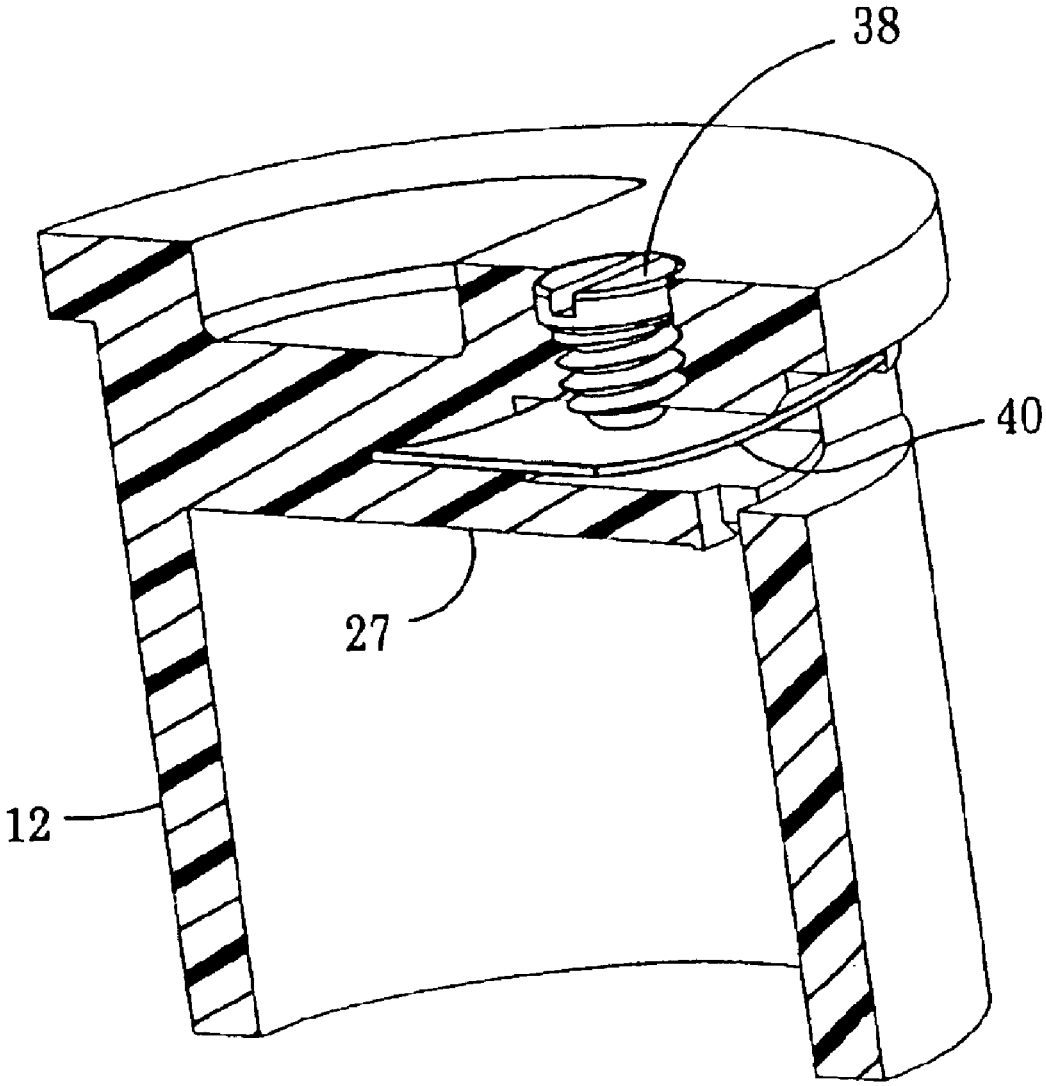
FIG. 13 is a perspective sectional view showing a modified form of the invention.

FIG. 13 illustrates an embodiment of the invention wherein a modified flexible reflector surface 40 is adjustable or deformable by operation of a threaded screw 38 to deform the reflector surface 40, to alter the configuration thereof and the spray configuration therefrom.

It will be understood that various changes and modifications may be made from the preferred embodiments discussed above without departing from the scope of the present invention, which is established by the following claims and equivalents thereof.

The inventors claim:

1. Sprinkler apparatus comprising:

a base adapted for attachment to a sprinkler assembly, a nozzle mounted on said base, said nozzle having a passage adapted to provide a liquid jet of a generally rectilinear cross-sectional configuration, means to supply liquid under pressure to the nozzle, a reflector surface disposed to be impacted by said liquid output jet from the nozzle, said nozzle and reflector surface being defined on a unitary nozzle device which is force-fitted into the base, said reflector surface being adapted and contoured to reflect said liquid jet in a spray to an area to be sprayed, said spray being of cross-sectional configuration generally similar to the rectilinear cross-sectional configuration of said liquid jet, the reflector surface having variations in the surface to reflect respective portions of spray at respective inclinations from the reflector to define respective portions of a predetermined spray pattern to respective portions of an area to be sprayed, whereby a spray pattern of a predetermined rectilinear cross-sectional configuration from the reflector surface is applied to the area to be sprayed.

2. Apparatus according to claim 1, wherein the surface configuration of the reflector is generally convex in two directions substantially at right angles to each other.

3. Apparatus according to claim 2, wherein variations in the general convex contour of the reflector surface to effect respective inclinations of spray portions, may be determined (a) emperically, (b) preferably by utilization of computer equipment and insertion thereinto of data including geometric relations of parts, angles, and dimensions.

4. Apparatus according to claim 1, wherein the reflector surface is defined on a flexible member on the apparatus, and further including:

a threaded member in an opening in the apparatus for adjustment of the configuration of the reflector.

5. Apparatus according to claim 1, wherein a step shoulder is defined in a wall portion of the nozzle apparatus adjacent an outlet end of the nozzle passage to deflect the liquid jet from an innermost portion of the reflector surface to prevent interference by inaccurate spray from the innermost reflector surface portion.

6. Apparatus according to claim 1, wherein the nozzle and reflector surface are defined on the unitary nozzle device having portions thereof adapted to be snapped into an upper portion of the base to mount the nozzle device on the base.

7. Sprinkler apparatus comprising:

a base adapted for attachment to a sprinkler and for liquid passage therethrough, a unitary nozzle device mounted on said base, said unitary nozzle device comprising an integrally formed nozzle passage and an integral reflector surface disposed in spaced-apart confronting relation, said reflector surface being disposed to be impacted by a liquid jet from the nozzle passage, said unitary nozzle device providing dimensional accuracy as between the nozzle and the reflector surface to enable accurate performance of the nozzle device and accurate repeatability in manufacture of the device, said nozzle passage being adapted to provide the liquid jet in a generally predetermined cross-sectional configuration, said reflector surface being contoured and adapted to reflect said liquid jet in a spray to an area having a cross-sectional configuration to be sprayed which is generally similar in cross-sectional configuration to that of said liquid jet, and a step shoulder defined in a wall portion of the nozzle device adjacent an outlet end of the nozzle passage to deflect the liquid jet from an innermost portion of the reflector surface to prevent interference by inaccurate spray from the innermost reflector surface portion, whereby a spray pattern of a substantially predetermined cross-sectional configuration is applied to an area to be sprayed.

8. Sprinkler apparatus comprising:

a base adapted for attachment to a sprinkler and for liquid passage therethrough, a unitary nozzle device mounted on said base, said unitary nozzle device comprising an integrally formed nozzle passage and an integral reflector surface disposed in spaced-apart confronting relation, said reflector surface being disposed to be impacted by a liquid jet from the nozzle passage, said unitary nozzle device providing dimensional accuracy as between the nozzle and the reflector surface to enable accurate performance of the nozzle device and accurate repeatability in manufacture of the device, a generally circular lower portion of the nozzle device being force-fitted into a circular opening in the base, and wherein an interior wall of the base provides a wall of the nozzle passage, said nozzle passage being adapted to provide the liquid jet in a generally predetermined cross-sectional configuration, and said reflector surface being contoured and adapted to reflect said liquid jet in a spray to an area having a cross-sectional configuration to be sprayed which is generally similar in cross-sectional configuration to that of said liquid jet, whereby a spray pattern of a substantially predetermined cross-sectional configuration is applied to an area to be sprayed.

* * * * *